US008137573B2

(12) United States Patent
Horiuchi

(10) Patent No.: US 8,137,573 B2
(45) Date of Patent: Mar. 20, 2012

(54) LIQUID EJECTION HEAD, METHOD FOR MANUFACTURING LIQUID EJECTION HEAD, AND METHOD FOR MANUFACTURING STRUCTURE

(75) Inventor: Isamu Horiuchi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 369 days.

(21) Appl. No.: 12/485,722

(22) Filed: Jun. 16, 2009

(65) Prior Publication Data

US 2009/0315950 A1 Dec. 24, 2009

(30) Foreign Application Priority Data

Jun. 19, 2008 (JP) ..... 2008-160773

(51) Int. Cl.
*B41J 2/14* (2006.01)

(52) U.S. Cl. ..... 216/27; 216/41; 216/58; 216/83; 29/890.1; 29/890.142

(58) Field of Classification Search ..... 216/27, 216/41, 58, 83; 29/890.1, 890.142
See application file for complete search history.

(56) References Cited

U.S. PATENT DOCUMENTS 5,478,606 A 12/1995 Ohkuma
2005/0067376 A1 * 3/2005 Park et al. ..... 216/27
2006/0114294 A1 * 6/2006 Kim ..... 347/63

FOREIGN PATENT DOCUMENTS

KR 10-2007-0022805 A1 2/2007

* cited by examiner

*Primary Examiner* — Shamim Ahmed
(74) *Attorney, Agent, or Firm* — Canon U.S.A., Inc. IP Division

(57) ABSTRACT

A method for manufacturing a liquid ejection head including a substrate and a member, disposed above the substrate, having passages communicatively connected to discharge ports through which a liquid is ejected includes providing first solid layers made of a positive photosensitive resin above the substrate such that outer side surfaces of the first solid layers form an obtuse angle with the substrate; providing a second solid layer above the substrate such that the second solid layer abuts the outer side surfaces of the first solid layers, the second solid layer being processed into at least one portion of a mold for the passages; exposing portions of the outer side surfaces of the first solid layers through the second solid layer; removing the exposed portions from the first solid layers; and providing a cover layer over the second solid layer, the cover layer being processed into the member.

11 Claims, 11 Drawing Sheets

FIG. 7 -- PRIOR ART--
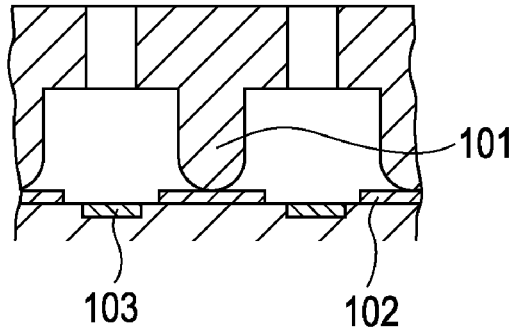
FIG. 8
-- PRIOR ART--
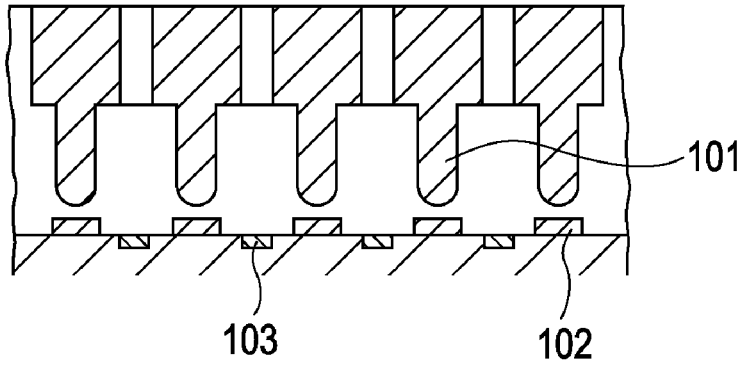

LIQUID EJECTION HEAD, METHOD FOR MANUFACTURING LIQUID EJECTION HEAD, AND METHOD FOR MANUFACTURING STRUCTURE

BACKGROUND OF THE INVENTION

1. Field of the Invention

The present invention relates to liquid ejection heads ejecting liquids, methods for manufacturing the liquid ejection heads, and methods for forming structures. The present invention particularly relates to a liquid ejection head that ejects ink toward a recording medium to perform recording, a method for manufacturing the liquid ejection head, and a method for forming a microstructure useful in semiconductor manufacture.

2. Description of the Related Art

An example of a process using a liquid ejection head ejecting a liquid is an ink jet recording process (liquid-ejecting recording process).

In general, ink jet recording heads used for the ink jet recording process include fine discharge ports, liquid passages, and energy-generating elements which are disposed in the liquid passages and which generate energy used to eject a liquid. A method for manufacturing such an ink jet recording head is disclosed in, for example, U.S. Pat. No. 5,478,606.

A pattern for forming passages is formed on a substrate having energy-generating elements using a soluble resin; a covering resin layer, containing an epoxy resin and a cationic photopolymerization initiator, for forming walls of the passage is formed on the pattern; discharge ports are formed on the energy-generating elements by photolithography; the soluble resin is dissolved off; and the covering resin layer is finally cured, whereby the passage walls are formed.

The method disclosed in U.S. Pat. No. 5,478,606 has a certain limitation in patterning accuracy because of a material currently used and is, however, capable of forming passage walls 101 well at a nozzle density of up to 600 dpi as shown in FIG. 7. With reference to FIG. 7, reference numeral 103 represents energy-generating elements which are arranged on a substrate and which generate energy used to eject a liquid. The passage walls 101 have an aspect ratio (height-to-length ratio) of 4:3. There is a problem in that it is difficult to form the passage walls 101 well at a nozzle density of 1,200 dpi because the resolution of a mold member containing a photosensitive material is insufficient. For example, when the passage walls 101 are spaced from a nozzle adhesion-improving layer 102 as shown in FIG. 8, nozzles adjacent to each other are communicatively connected to each other and therefore are affected by crosstalk. This may affect the ejection of ink.

A possible measure against the problem is to replace the photosensitive material with a high-resolution material. However, it is difficult to immediately develop such a high-resolution material. Another possible measure against the problem is to reduce the thickness of the mold member. An increase in nozzle density to 1,200 dpi leads to a reduction in the length of each passage. This may causes the nozzles to be insufficiently refilled with ink. In order to keep the cross-sectional area of the passage and in order to prevent the insufficient refilling thereof, the height of the passage needs to be high. A reduction in the thickness of the mold member, which is used to form the passage, leads to a reduction in the height of the passage and therefore is practically difficult. The above two measures may be impractical in solving the problem due to an increase in nozzle density.

SUMMARY OF THE INVENTION

The present invention provides a liquid ejection head in which passages and discharge ports are densely arranged and are, however, prevented from being communicatively connected to each other and in which walls of the passages are securely bonded to a substrate. The present invention provides a method for manufacturing the liquid ejection head. Furthermore, the present invention provides a method for forming a microstructure useful in manufacturing a semiconductor other than the liquid ejection head.

An aspect of the present invention provides a method for manufacturing a liquid ejection head including a substrate and a member which is disposed above the substrate and which has passages communicatively connected to discharge ports through which a liquid is ejected. The method includes providing first solid layers made of a positive photosensitive resin above the substrate such that outer side surfaces of the first solid layers form an obtuse angle with the substrate; providing a second solid layer above the substrate such that the second solid layer abuts the outer side surfaces of the first solid layers, the second solid layer being processed into at least one portion of a mold for the passages; exposing portions of the outer side surfaces of the first solid layers through the second solid layer; removing the exposed portions from the first solid layers; and providing a cover layer over the second solid layer, the cover layer being processed into the member.

According to the method, the liquid ejection head can be manufactured such that the passages and the discharge ports are densely arranged, the passages are prevented from being communicatively connected to each other, and the length of the passages is secured.

According to the method, the passages are greater in cross-sectional area than those formed by a conventional method when the passages are arranged at the same density as the density of those formed by the conventional method. This allows an increase in refilling rate.

When the passages are equal in cross-sectional area to those formed by the conventional method, the contact area between the substrate and each wall of the passages can be increased as compared to the conventional method; hence, the passage walls can be formed so as to be excellent in adhesion.

Further features of the present invention will become apparent from the following description of exemplary embodiments with reference to the attached drawings.

BRIEF DESCRIPTION OF THE DRAWINGS

FIG. 7 is a cross-sectional view illustrating a method for manufacturing a conventional liquid ejection head.

FIG. 8 is a cross-sectional view illustrating a method for manufacturing a conventional liquid ejection head.

DESCRIPTION OF THE EMBODIMENTS

Embodiments of the present invention will now be described with reference to the attached drawings.

Liquid ejection heads below can be installed in apparatuses such as printers, copiers, facsimile machines including communication systems, and word processors including printer sections; industrial recording apparatuses combined with various processors; and the like. The liquid ejection heads are useful in recording data on various recording media made of paper, yarn, fiber, fabric, leather, metal, plastic, glass, wood, or ceramic. The term "recording" as used herein shall mean not only providing a meaningful image such as a letter, a character, or a figure on a recording medium but also providing a meaningless image such as a pattern on a recording medium.

The term "ink" or "liquid" as used herein should be construed broadly and shall mean a liquid that is provided on a recording medium such that an image, a figure, or a pattern is formed on the recording medium or the recording medium or ink is treated. The treatment of the recording medium or ink provided on the recording medium is as follows: a colorant contained in the ink is solidified or insolublized such that the fixation of the ink, the coloration of the ink, the quality of a recorded image, the durability of the recorded image, and/or the like is improved.

First Embodiment

Figure 1:
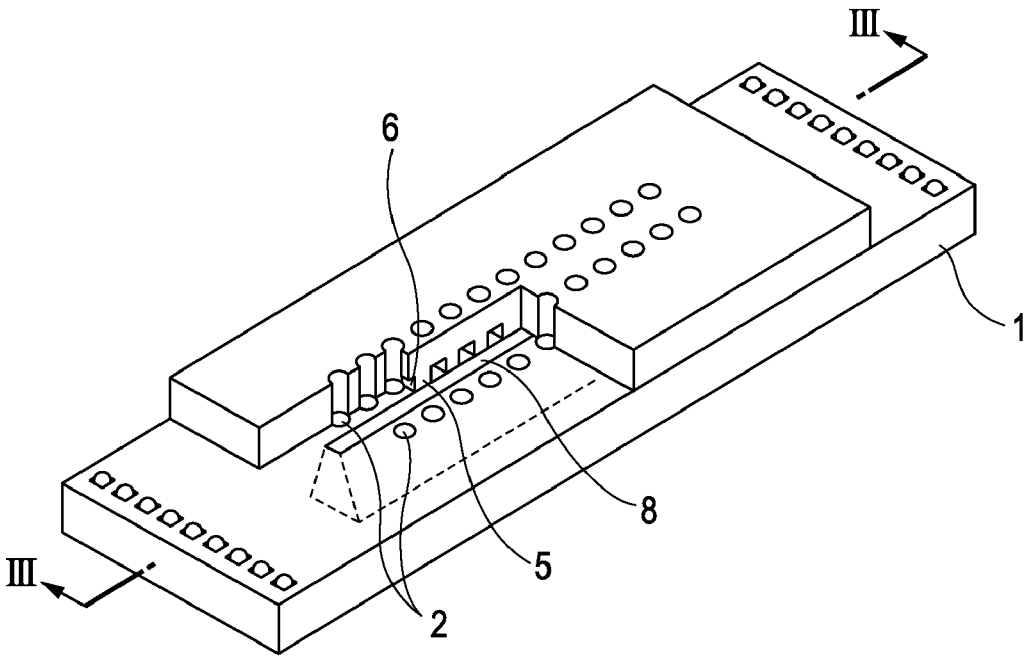
FIG. 1 is a schematic view of a liquid ejection head according to a first embodiment of the present invention.

FIG. 1 shows a liquid ejection head according to a first embodiment of the present invention.

The liquid ejection head includes a substrate 1, made of silicon, including energy-generating elements 2 generating energy used to discharge a liquid. The energy-generating elements 2 are arranged in two rows at predetermined intervals. The substrate 1 has a supply port 8, formed by anisotropically etching the substrate 1, extending between the two rows of the energy-generating elements 2. The substrate 1 is overlaid with a passage-forming member 5 which has discharge ports 6 located at positions opposed to the energy-generating elements 2 and which has separate passages communicatively connected to the supply port 8 and the discharge ports 6. The positions of the discharge ports 6 are not limited to the positions opposed to the energy-generating elements 2.

In the case of using the liquid ejection head as an ink jet recording head, the liquid ejection head is placed such that a surface of the liquid ejection head that has the discharge ports 6 faces a recording surface of a recording medium. In the liquid ejection head, the energy generated by the energy-generating elements 2 is applied to ink supplied to the passages through the supply port 8 such that droplets of the ink are discharged from the discharge ports 6, whereby the ink droplets are applied to the recording medium. Examples of the energy-generating elements 2 include, but are not limited to, electrothermal transducers (so-called heaters) for generating thermal energy and piezoelectric transducers for generating mechanical energy.

Second Embodiment

A method for manufacturing a liquid ejection head according to a second embodiment of the present invention will now be described. In descriptions below, components having the same functions are denoted by the same reference numerals in the attached drawings and will not be described in detail.

Figure 2:
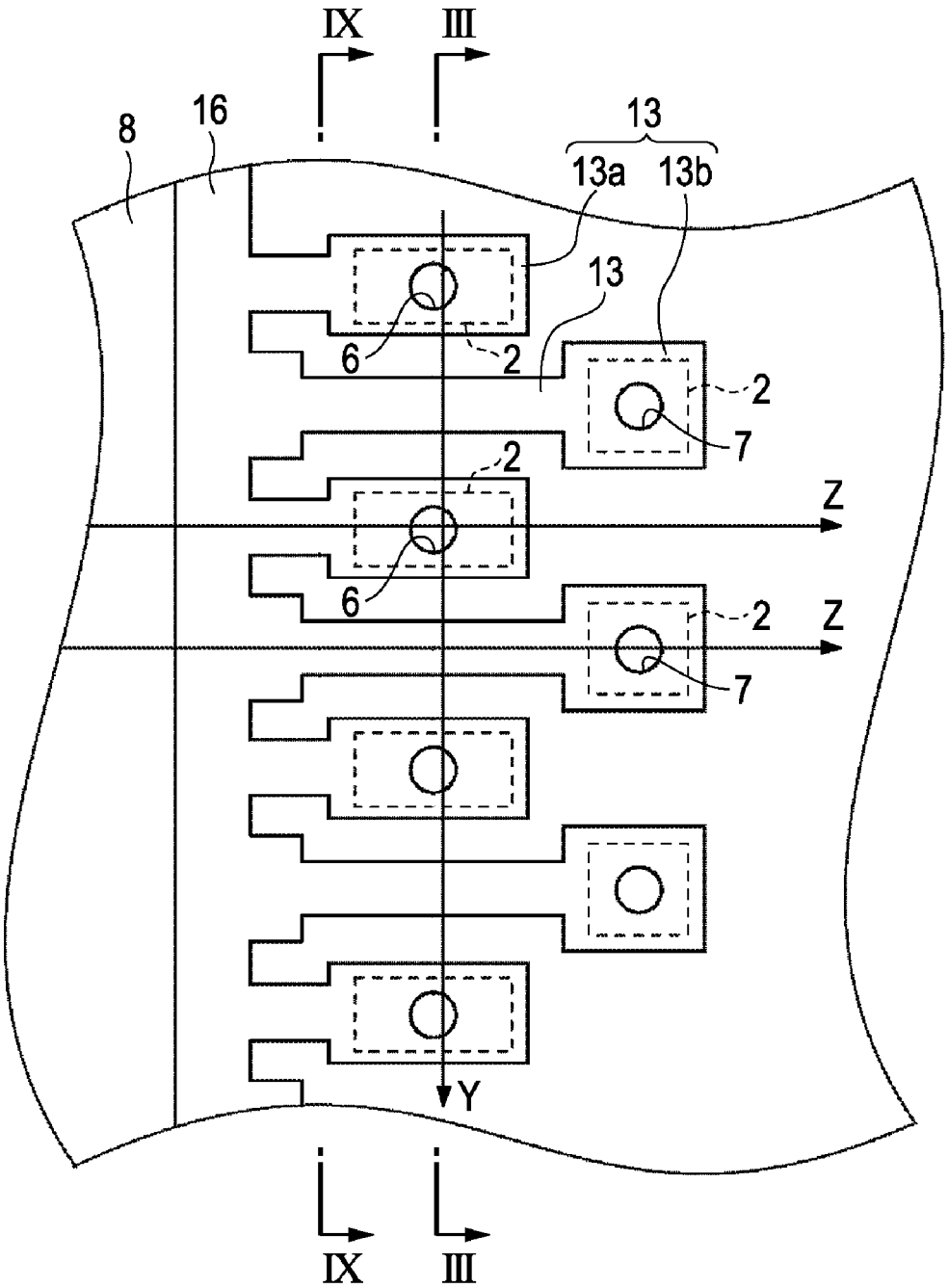
FIG. 2 is a perspective view of the liquid ejection head according to the first embodiment.

FIG. 2 shows the liquid ejection head in perspective plan view. In FIG. 2, the liquid ejection head is viewed in the direction from a discharge port to a substrate surface. In the liquid ejection head, first discharge ports 6 are located relatively close to the supply port 8 and second discharge ports 7 are located relatively far from the supply port 8. The first and second discharge ports 6 and 7 are alternately arranged on one side of the supply port 8 and are communicatively connected to common liquid chambers 16 through passages 13. The passages 13 have regions containing energy-generating elements 2. The regions are separately referred to as first energy-generating chambers 13*a* or second energy-generating chambers 13*b* in some cases. The first energy-generating chambers 13*a* are located close to the supply port 8 and the second energy-generating chambers 13*b* are located far from the supply port 8. In FIG. 2, the direction from the supply port 8 to each of the first and second discharge ports 6 and 7 is the Z-direction. The Z-direction may be referred to as the direction from the supply port 8 to each of the energy-generating elements 2. The direction that intersects with the Z-direction and that is substantially parallel to the arrangement direction of the energy-generating elements 2 or the arrangement direction of the first or second discharge ports 6 or 7 is defined as the Y-direction.

FIGS. 3A to 3H show steps of the method, are sectional views taken along the line III-III of FIG. 2, that is, along the Y-direction, and correspond to a sectional view taken along the line III-III of FIG. 1.

Figure 3A:
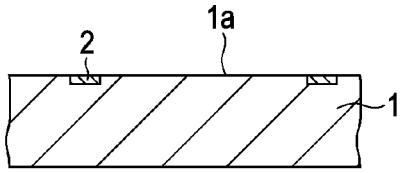
FIGS. 3A to 3H are cross-sectional views illustrating a method for manufacturing a liquid ejection head according to a second embodiment of the present invention.

As shown in FIG. 3A, a substrate 1 including the energy-generating elements 2 is prepared. The energy-generating elements 2 generate energy used to eject a liquid.

Figure 3B:
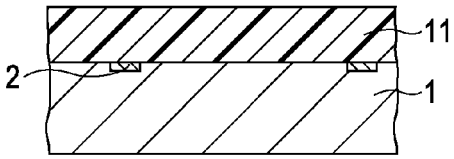

As shown in FIG. 3B, a layer 11 of a positive photosensitive resin is provided on the substrate 1. Examples of the positive photosensitive resin include vinyl ketone polymers such as poly(methyl isopropenyl ketone) and poly(vinyl ketone); methacrylic polymers such as polymethacrylic acid, poly(methyl methacrylate), poly(ethyl methacrylate), poly(n-butyl methacrylate), poly(phenyl methacrylate), polymethacrylic amide, and poly(methacrylonitrile); and olefin sulfone polymers such as polybutene-1-sulfone and polymethylpentene-1-sulfone.

Figure 3C:
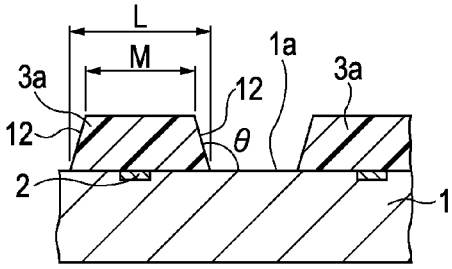

As shown in FIG. 3C, first solid layers 3*a* made of the positive photosensitive resin are provided on the substrate 1. The first solid layers 3*a* have side surfaces 12 that form an obtuse angle with a principal surface 1*a* of the substrate 1. The side surfaces 12 thereof are outer surfaces and therefore may be referred to as outer side surfaces.

Figure 12:
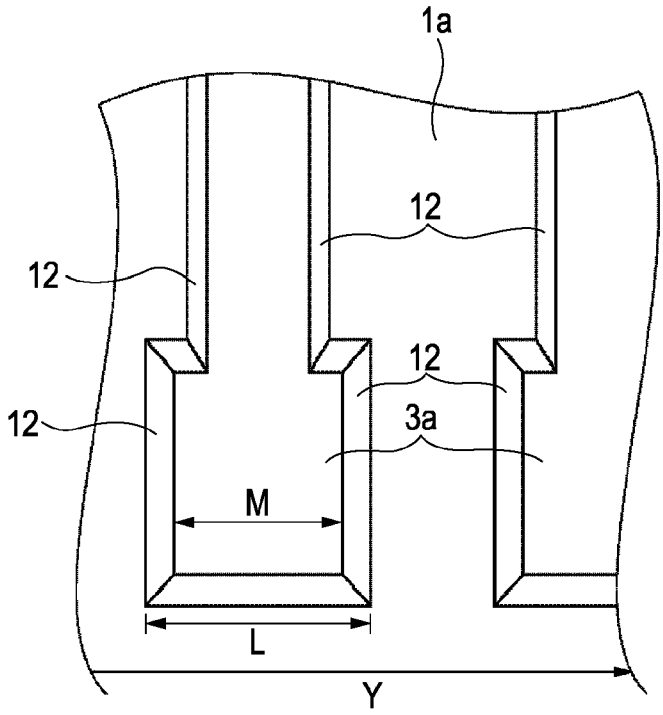
FIG. 12 is a plan view of a principal surface of a substrate processed in a step of the method according to the first embodiment.

See FIG. 12 in addition to FIG. 3C. FIG. 12 is a plan view of the principal surface 1*a* of the substrate 1 shown in FIG. 3C. As shown in FIGS. 3C and 12, the first solid layers 3*a* have the side surfaces 12. The side surfaces 12 thereof need not necessarily be continuous or uniform. The first solid layers 3*a* have bottom portions located on the substrate side and upper portions located on the side opposite to the substrate 1. The length L of the bottom portions is greater than the length M of the upper portions when viewed in the Y-direction.

Figure 11:
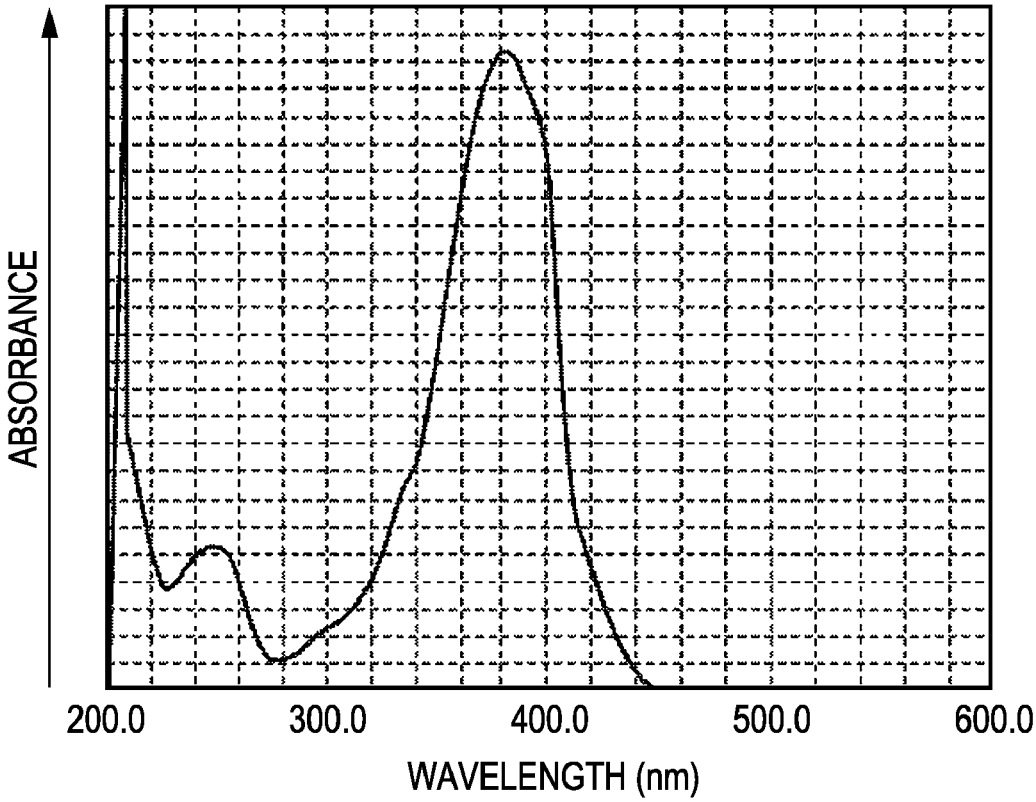
FIG. 11 is a graph showing the absorption spectrum of an ultraviolet absorber usable herein.

The angle θ between the principal surface 1*a* of the substrate 1 and each side surface 12 of the first solid layers 3*a* is obtuse, that is, the angle θ therebetween is greater than 90 degrees as shown in FIG. 3C. For example, proximity exposure may be used to form the side surfaces 12 thereof. The angle θ therebetween can be controlled by adjusting the focus height during exposure or adding an absorber absorbing exposure light to the first solid layers 3*a*. Alternatively, the angle θ therebetween can be controlled by adding an ultraviolet absorber having absorption properties shown in FIG. 11 to the first solid layers 3*a*.

Figure 3D:
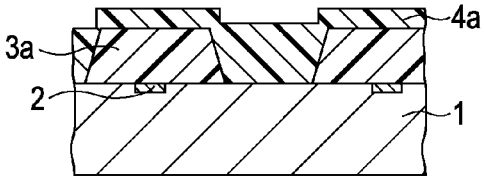

As shown in FIG. 3D, a second solid layer 4*a* is provided over the first solid layers 3*a* so as be in contact with the side surfaces 12 thereof. Examples of a material for forming the second solid layer 4*a* include vinyl ketone polymers such as poly(methyl isopropenyl ketone) and poly(vinyl ketone); methacrylic polymers such as polymethacrylic acid, poly(methyl methacrylate), poly(ethyl methacrylate), poly(n-butyl methacrylate), poly(phenyl methacrylate), polymethacrylic amide, and poly(methacrylonitrile); and olefin sulfone polymers such as polybutene-1-sulfone and polymethylpentene-1-sulfone. This material preferably highly transmits light having a wavelength suitable for exposing the first solid layers 3*a* in a subsequent step and preferably has a transmittance of 80% or more.

Figure 3E:
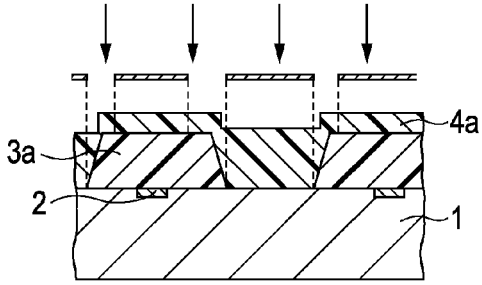

As shown in FIG. 3E, the second solid layer 4*a* is exposed.

Figure 3F:
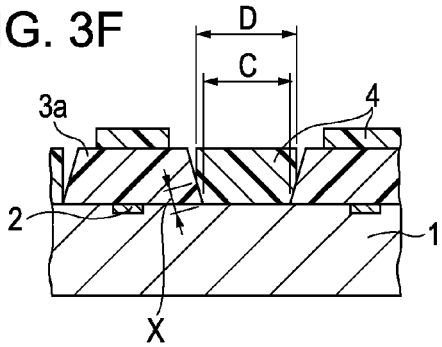

As shown in FIG. 3F, the second solid layer 4*a* is developed, whereby a second pattern 4 with a passage shape is formed. The passage shape can be formed so as to have a multistage structure excellent in discharge efficiency and refilling efficiency in such a manner that portions of the second pattern 4 are provided on the first solid layers 3*a*. Side surfaces of the second pattern 4 have transfer portions X transferred from slope portions of the side surfaces 12 of the first solid layers 3*a*. The transfer portions X each form an acute angle with the principal surface 1*a* of the substrate 1. The second pattern 4 has bottom portions C located on the substrate side and upper portions D which are located on the side opposite to the substrate 1 and which are longer than the bottom portions C. It is usually difficult to accurately form a shape having a bottom portion and an upper portion longer than the bottom portion by processing the positive photosensitive resin; however, the above steps allow the second pattern 4 to be accurately formed.

Figure 3G:
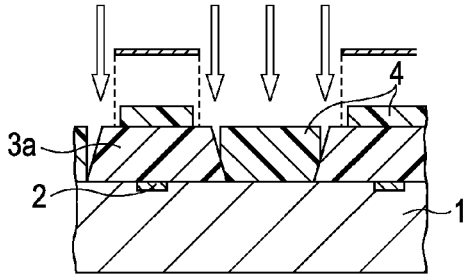

As shown in FIG. 3G, the first solid layers 3*a* are exposed through the second pattern 4. In this step, the first solid layers 3*a* are preferably exposed to light which passes through the second pattern 4 and which is absorbed by the first solid layers 3*a*.

Figure 3H:
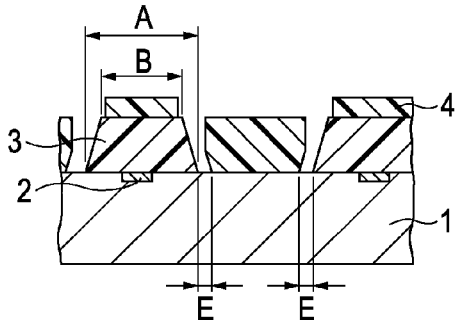

As shown in FIG. 3H, the first solid layers 3*a* are developed, whereby portions abutting the second pattern 4 are removed from the first solid layers 3*a* and therefore a first pattern 3 is formed so as to be spaced from the second pattern 4. In this step, the first pattern 3 can be formed such that the angle between the principal surface 1*a* of the substrate 1 and each side surface of the first pattern 3 is equal to the angle θ between the principal surface 1*a* thereof and each side surface 12 of the first solid layers 3*a*. That is, the first pattern 3 can be formed such that side surfaces of the first pattern 3 are parallel to the transfer portions X of the side surfaces of the second pattern 4.

In this embodiment, the side surfaces 12 of the first solid layers 3*a* are arranged in the Z-direction, one of each two adjacent passages 13 is formed using the second solid layer 4*a*, which have the transfer portions X transferred from the slope portions of the side surfaces 12 of the first solid layers 3*a*, as a mold and the other is formed using the first pattern 3, which is obtained from the first solid layers 3*a*, as a mold. This allows the area and cross-sectional area of each passage 13 to be secured. The angle θ between the principal surface 1*a* of the substrate 1 and outer surface, parallel to the Y-direction in FIG. 2, of the first solid layers 3*a* need not necessary be obtuse. The passages 13 extend from the common liquid chambers 16 and have a comb tooth shape. The shape of the passages 13 is not limited to such a comb tooth shape.

Figure 4A:
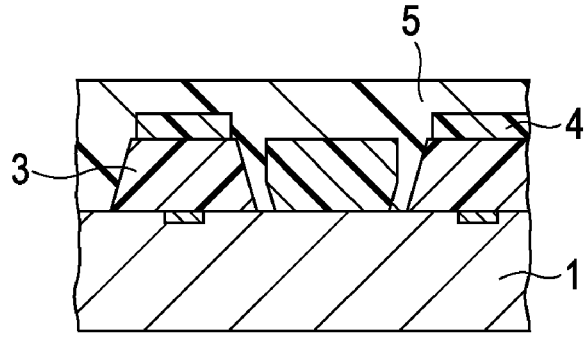
FIGS. 4A to 4C are cross-sectional views illustrating the method according to the second embodiment.

As shown in FIG. 4A, a passage-forming member 5 serving as a cover layer is formed over the first and second patterns 3 and 4 by a coating process. The passage-forming member 5 is preferably made of a negative photosensitive resin which has high mechanical strength, weather resistance, ink resistance, and adhesion to the substrate 1 and which can be used together with a solvent having low compatibility with the first and second patterns 3 and 4. A typical example of the negative photosensitive resin is an alicyclic epoxy resin, which can be cured with a cationic photopolymerization catalyst.

Figure 4B:
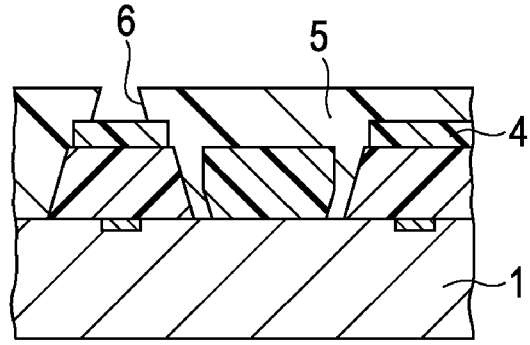

As shown in FIG. 4B, the passage-forming member 5 is patterned, whereby the first discharge ports 6 are formed at positions corresponding to the energy-generating elements 2.

Figure 4C:
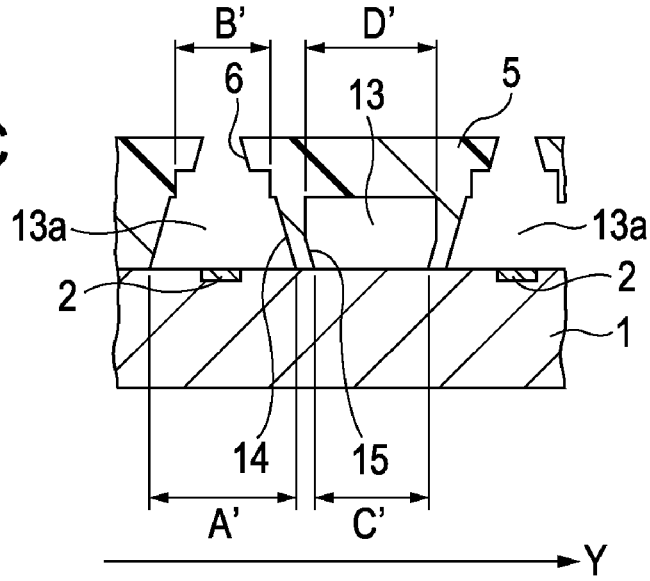

As shown in FIG. 4C, the first and second patterns 3 and 4 are removed, whereby the passages 13 and the first energy-generating chambers 13*a* are formed. The passages 13 have bottom portions C' and upper portions D' longer than the bottom portions C' because the shape of the passages 13 corresponds to that of the second pattern 4, that is, the bottom portions C' and upper portions D' of the passages 13 correspond to the bottom portions C and upper portions D, respectively, of the second pattern 4. When side surfaces of the first pattern 3 are parallel to the transfer portions X (shown in FIG. 3F) of the second pattern 4, side surface portions 15 of the passages 13 are parallel to side surfaces 14 of the first energy-generating chambers 13*a*.

Necessary electrical connections are then provided, whereby the liquid ejection head is completed.

As shown in FIG. 4C, the first energy-generating chambers 13*a*, which are located close to the supply port 8 (not shown), each have a first portion A' located on the substrate side and a second portion B' which is located on the discharge port side and which is shorter than the first portion A' when viewed in the direction (the Y-direction) intersecting with the direction (the Z-direction in FIG. 2) from the supply port 8 to each energy-generating element 2. The distance between portions of the adjacent first energy-generating chambers 13*a* that are located on the front surface side of the substrate 1 is small. The passages 13 communicatively connected to the second energy-generating chambers 13*b*, which are located far from the supply port 8 (not shown), have the bottom portions C' and the upper portions D', which are longer than the bottom portions C'. Therefore, the cross-sectional area of each passage 13 can be gained.

Third Embodiment

A method for manufacturing a liquid ejection head according to a third embodiment of the present invention includes the same steps as those described in the first embodiment with reference to FIGS. 3A to 3D. The method further includes steps below.

Figure 5A:
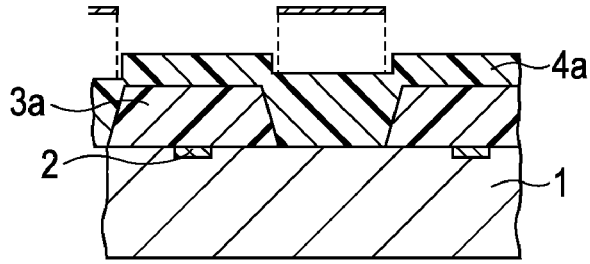
FIGS. 5A to 5D are cross-sectional views illustrating a method for manufacturing a liquid ejection head according to a third embodiment of the present invention.

As shown in FIG. 5A, a second solid layer 4*a* extending over first solid layers 3*a* is exposed.

Figure 5B:
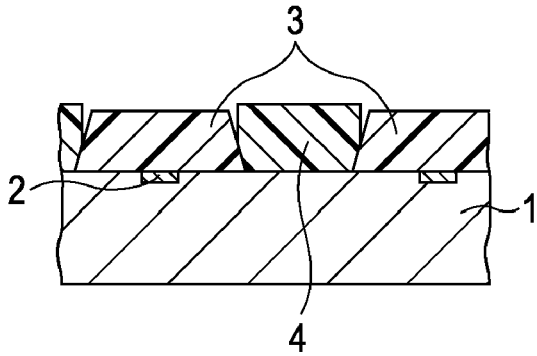

As shown in FIG. 5B, the second solid layer 4*a* is developed, whereby a second pattern 4 is formed between the first solid layers 3*a*.

Figure 5C:
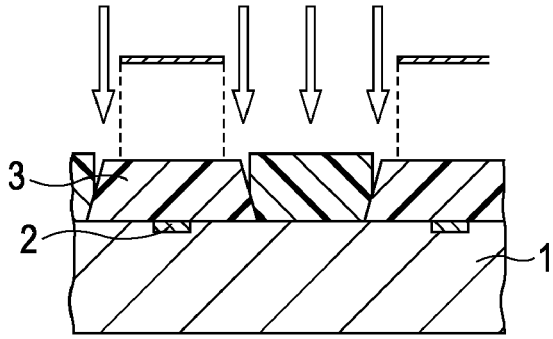

As shown in FIG. 5C, the second pattern 4 is exposed through the second solid layer 4*a*.

Figure 5D:
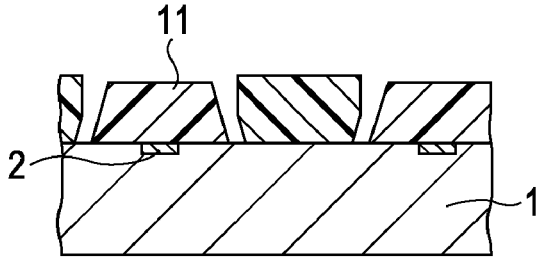

As shown in FIG. 5D, the first solid layers 3*a* are developed, whereby portions abutting the second pattern 4 are removed from the first solid layers 3*a* and therefore a first pattern 3 is formed so as to be spaced from the second pattern 4. This allows a pattern having a passage shape in which the second pattern 4 is not present on the first pattern 3 to be formed.

A passage-forming member and discharge ports can be formed through the same steps as those described in the first embodiment with reference to FIGS. 4A to 4C.

Fourth Embodiment

A method for manufacturing a liquid ejection head according to a fourth embodiment of the present invention includes the same steps as those described in the first embodiment with reference to FIGS. 3A to 3D. The method further includes steps below.

Figure 6A:
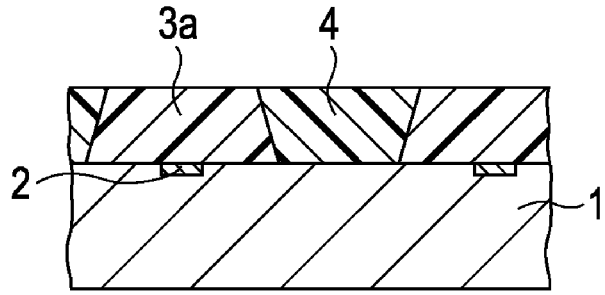
FIGS. 6A to 6C are cross-sectional views illustrating a method for manufacturing a liquid ejection head according to a fourth embodiment of the present invention.

A second solid layer 4*a* is polished toward a substrate until first solid layers 3*a* are uncovered, whereby a second pattern 4 is formed. This allows the upper surfaces of the first solid layers 3*a* and the upper surface of the second pattern 4 to be planarized as shown in FIG. 6A. A chemical mechanical polishing process or the like can be used to polish the second solid layer 4*a*. In order to prevent or inhibit the formation of scratches (micro-flaws) and/or the occurrence of dishing (asperity) on a polished surface of the second solid layer 4*a*, polishing conditions such as pressure, rotation speed, and abrasive grains (aluminum or silica grains) are preferably optimized depending on a material used to form the second solid layer 4*a*.

Figure 6B:
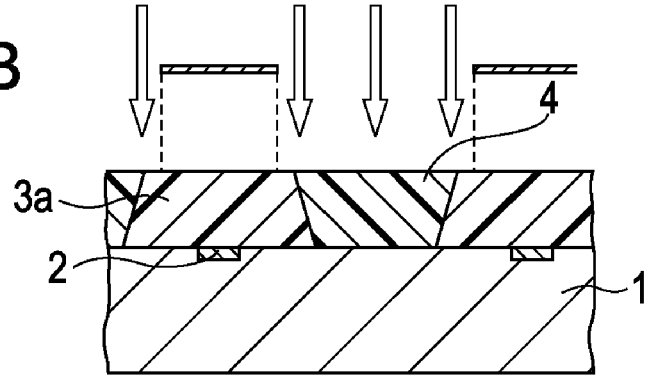

As shown in FIG. 6B, the first solid layers 3*a* are exposed through the second pattern 4.

Figure 6C:
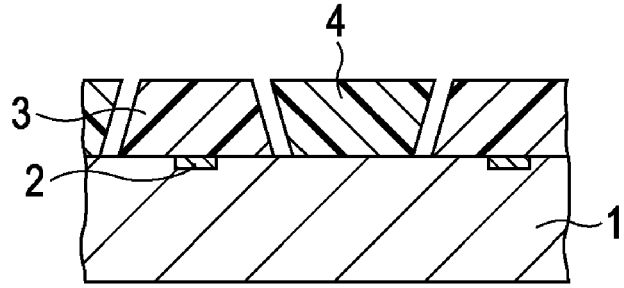

As shown in FIG. 6C, the first solid layers 3*a* are developed, whereby portions abutting the second pattern 4 are removed from the first solid layers 3*a* and therefore a first pattern 3 is formed so as to be spaced from the second pattern 4.

The liquid ejection head can be obtained through the same steps as those subsequent to the step described in the first embodiment with reference to FIG. 4A.

In this embodiment, the upper surfaces of the first and second patterns 3 and 4 are planarized by polishing and therefore have high flatness.

In this embodiment, the first solid layers 3*a* are patterned by exposure but the second solid layer 4*a* is not patterned; hence, a material insensitive to light can be used to form the second solid layer 4*a*.

Fifth Embodiment

A fifth embodiment of the present invention will now be described with reference to FIGS. 9A to 9G.

FIGS. 9A to 9G are cross-sectional views taken along the line IX-IX of FIG. 2.

Figure 9A:
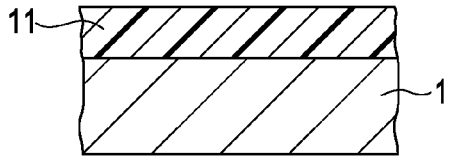
FIGS. 9A to 9G are cross-sectional views illustrating a method for manufacturing a liquid ejection head.

As shown in FIG. 9A, a substrate 1 carrying a layer 11 of a positive photosensitive resin is prepared.

Figure 9B:
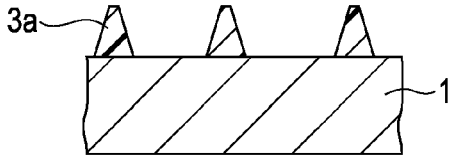

As shown in FIG. 9B, the positive photosensitive resin layer 11 is patterned, whereby first solid layers 3*a* made of the positive photosensitive resin are formed on the substrate 1. The first solid layers 3*a* have bottom portions, upper portions smaller than the bottom portions, and slopes that make an obtuse angle with a principal surface 1*a* of the substrate 1.

Figure 9C:
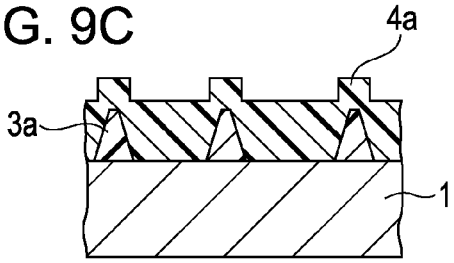

As shown in FIG. 9C, a second solid layer 4*a* is formed on the first solid layers 3*a* so as to abut the slopes of the first solid layers 3*a*. The second solid layer 4*a* may cover the first solid layers 3*a*.

Figure 9D:
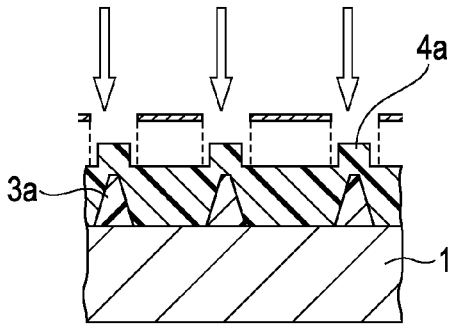

As shown in FIG. 9D, the second solid layer 4*a* is exposed.

Figure 9E:
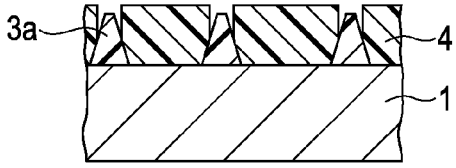

As shown in FIG. 9E, the second solid layer 4*a* is developed, whereby a pattern 4 is formed and the first solid layers 3*a* are partly uncovered. The pattern 4 has side portions transferred from the slopes of the first solid layers 3*a* and therefore has bottom portions and upper portions longer than the bottom portions.

Figure 9F:
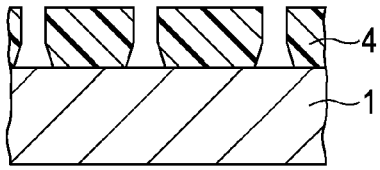

As shown in FIG. 9F, the first solid layers 3*a* are removed.

In this step, the first solid layers 3*a* may be globally exposed as required and then removed with a solvent or the like.

Figure 9G:
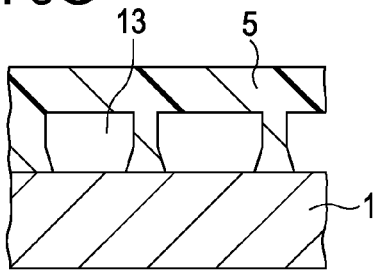

Steps subsequent to the step shown in FIG. 9F are the same as those described in the first embodiment with reference to FIGS. 4A to 4C. A liquid ejection head is obtained through the above-mentioned steps. As shown in FIG. 9G, the liquid ejection head includes passages 13 having bottom portions and upper portions longer than the bottom portions.

A pattern formed by a method for forming a pattern for forming the passages 13 described above can be used as a microstructure in an MEMS field and so on. That is, a method for forming a first passage pattern 3 and a second passage pattern 4 on a substrate as described above can be used as a method for forming a microstructure for forming a microstructure and another microstructure on such a substrate as described above in various industrial fields.

EXAMPLES

The present invention will be further described in detail with reference to examples.

Example

An example of the present invention is described below with reference to FIGS. 3A to 3H.

A liquid ejection head was prepared and then evaluated as described below.

A plurality of heaters 2 acting as energy-generating elements were provided on a Si substrate 1 as shown in FIG. 3A. The heaters 2 were connected to electrodes (not shown) for inputting control signals for operating the heaters 2 to the heaters 2.

An adhesive layer (not shown) made of polyether amide was formed on the Si substrate 1.

A film was formed on the adhesive layer by spin coating using a solution prepared by dissolving poly(methyl isopropenyl ketone) in an appropriate solvent and then baked at 150° C. for six minutes, whereby first solid layers 3*a* with a thickness of 11 μm were formed as shown in FIG. 3B.

The first solid layers 3*a* were exposed at a wavelength of 260 nm or more using an exposure system, UX3000™, available from Ushio Inc., whereby a first passage pattern 3 was formed as shown in FIG. 3C. The first solid layers 3*a* had side surfaces forming an angle of 115 degrees with a principal surface of the Si substrate 1, bottom portions with a length L of 34 μm, and upper portions with a length M of 28 μm.

A film was formed over the first solid layers 3*a* by spin coating using a resin principally containing methyl methacrylate and then baked at 90° C for 20 minutes, whereby a second solid layer 4*a* as shown in FIG. 3D.

The second solid layer 4*a* was exposed at a wavelength of 250 nm or less using an exposure system, UX3000™, available from Ushio Inc., whereby a second passage pattern 4 was formed as shown in FIG. 3E. The second passage pattern 4 had bottom portions with a length C of 9.5 μm and upper portions with a length D of 14.5 μm as shown in FIG. 3F. Since the second solid layer 4*a* was formed over the first solid layers 3*a*, the second passage pattern 4 has a thickness of about 11 μm.

The first solid layers 3*a* were exposed at a wavelength of 260 nm or more again and then developed, whereby the first passage pattern 3 was formed. The distance E between the first and second passage patterns 3 and 4 was 6 μm. The first passage pattern 3 had upper portions with a length B of 16 μm and bottom portions with a length A of 22 μm as shown in FIG. 3H. The second passage pattern 4 is disposed on the first passage pattern 3.

A passage-forming member 5 made of an epoxy resin was formed as shown in FIG. 4A; exposed with a mask aligner, MPA-600™, available from CANON KABUSHIKI KAISHA; and then developed, whereby discharge ports 6 were formed in the passage-forming member 5 as shown in FIG. 4B.

A film was formed by spin coating using a protective layer-forming material and then dried at 80° C. to 120° C., whereby a protective layer (not shown) for protecting the discharge ports 6 during etching was formed. A mask was provided on the back surface of the Si substrate 1. The back surface thereof was anisotropically etched through the mask, whereby a supply port (not shown) was formed.

The protective layer was removed and the first and second passage patterns 3 and 4 were dissolved off, whereby passages 13 were formed. The passage-forming member 5, which was made of the epoxy resin, was cured by heating the passage-forming member 5 at 200° C. for one hour, whereby the liquid ejection head was obtained as shown in FIG. 4C. The passages 13 had a shape following the shape of the passage pattern and therefore walls between the passages 13 adjacent to each other had a thickness E' of 6 μm. The passages 13 sandwiched between energy-generating chambers 13*a* adjacent to each other had upper portions with a length D' of 14.5 μm and bottom portions with a length C' of 9.5 μm and had a height of about 11 μm depending on the second passage pattern 4.

Comparative Example

A method for manufacturing a comparative liquid ejection head is described below with reference to FIGS. 10A to 10H.

FIGS. 10A to 10H are schematic cross-sectional views illustrating the method and are similar to the cross-sectional views used in the example.

Figure 10A:
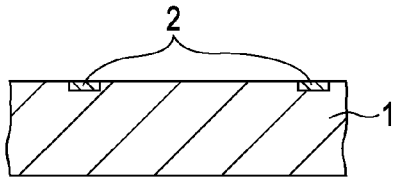
FIGS. 10A to 10H are cross-sectional views illustrating a method for manufacturing a comparative liquid ejection head.

A plurality of heaters 2 acting as energy-generating elements were provided on a Si substrate 1 as shown in FIG. 10A.

An adhesion enhancement layer (not shown) made of polyether amide was formed on the Si substrate 1.

Figure 10B:
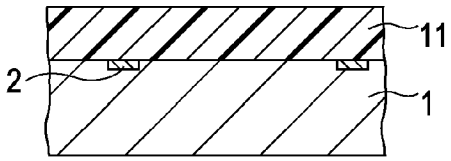

A film was formed on the adhesion enhancement layer by spin coating using a solution prepared by dissolving poly (methyl isopropenyl ketone) in an appropriate solvent and then baked at 130° C. for six minutes, whereby a first solid layer 11 with a thickness of 11 μm were formed as shown in FIG. 10B.

Figure 10C:
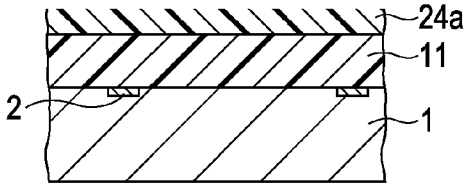

A film was formed on the first solid layer 11 by spin coating using a resin principally containing methyl methacrylate and then baked at 120° C. for six minutes, whereby a second solid layer 24*a* as shown in FIG. 10C.

Figure 10D:
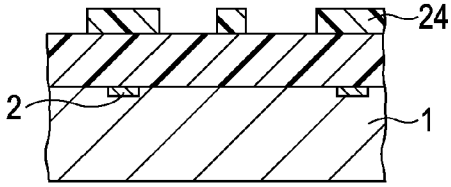

The second solid layer 24*a* was exposed at a wavelength of 250 nm or less using an exposure system, UX3000™, available from Ushio Inc., whereby a second pattern 24 was formed as shown in FIG. 10D.

The first solid layer 11 was exposed at a wavelength of 260 nm or more, whereby a first pattern 23 was formed. The first pattern 23 had first sections 23*a* corresponding to energy-generating chambers. The first sections 23*a* had a tilt angle θ of 75 degrees. The reason why the tilt angle θ of the first sections 23*a* is less than 90 degrees is as follows: the first solid layer 11 is made of a positive photosensitive resin and therefore absorbs exposure light to react, light traveling through the first solid layer 11 is attenuated and therefore has low intensity at a lower portion thereof, and masked upper portions of the first solid layer 11 are exposed to diffracted light. The first sections 23*a*, as well as the first passage pattern 3 of the example, had bottom portions with a length F of 22 μm and upper portions with a length G of 16 μm. The second pattern 24 was disposed on the first pattern 23 and had the same shape as that of the second passage pattern 4 of the example.

Figure 10E:
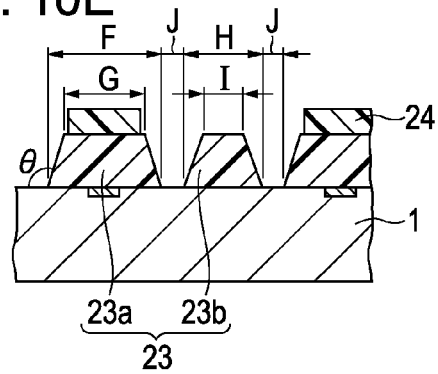

The first pattern 23 had second sections 23*b* disposed between the first sections 23*a*. The second sections 23*b* had bottom portions with a length H of 9.5 μm and upper portions with a length I of 3.6 μm because the second sections 23*b* were formed together with the first sections 23*a* by exposure. This is probably due to the same reason as why the tilt angle θ of the first sections 23*a* is less than 90 degrees. The distance J, as well as the distance E described in the example, between each second section 23*b* and a corresponding one of the first sections 23*a* was 6 μm as shown in FIG. 10E.

Figure 10F:
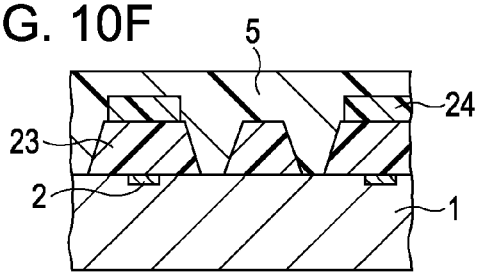
Figure 10G:
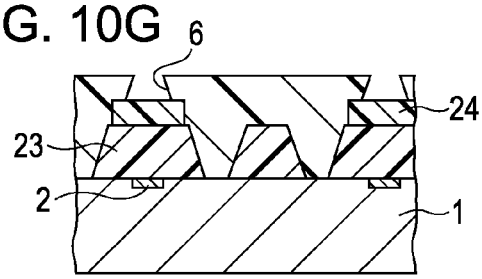
Figure 10H:
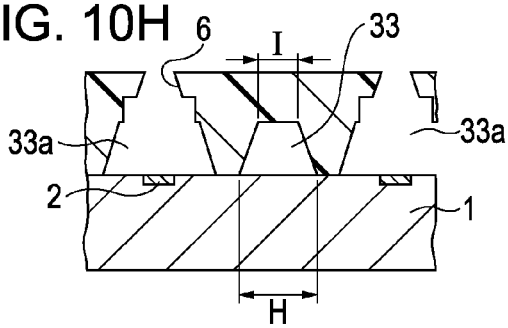

A passage-forming member 5 was provided above the Si substrate 1 as shown in FIG. 10F, discharge ports 6 were formed in the passage-forming member 5 as shown in FIG. 10G, and the first pattern 23 was removed in the same manner as that described in the example, whereby the comparative liquid ejection head was obtained as shown in FIG. 10H.

As shown in FIG. 10H, the comparative liquid ejection head included energy-generating chambers 33*a* and passages 33 each disposed between the adjacent energy-generating chambers 33*a*. The passages 33 had bottom portions with a length H' of 9.5 μm and upper portions with a length I' of 3.6 μm.

In comparison between the example and the comparative example, the energy-generating chambers 33*a* have the same shape. Walls between the energy-generating chambers and the passages disposed between the energy-generating chambers have the same thickness (E=J=6 μm); hence, the contact area between the substrate 1 and the passage-forming member 5 does not vary and the adhesion between the substrate 1 and the passage-forming member 5 does not vary. The passages 13 (an upper length of 14.5 μm, a bottom length of 9.5 μm, and a height of 11 μm) disposed between the energy-generating chambers 13*a* of the example has a cross-sectional area greater than that of the passages 33 (an upper length of 3.6 μm, a bottom length of 9.5 μm, and a height of 11 μm) of the comparative example. Therefore, according to the present invention, passages can be increased in cross-sectional area with the adhesion between a substrate and a passage-forming member maintained; hence, refilling rate can be increased. When print duty may be low, the contact area between the passage-forming member 5 and the substrate 1 can be increased in such a manner that the cross-sectional area of the passages 13 of the example is reduced to that of the comparative example. In this case, the adhesion between the passage-forming member 5 and the substrate 1 can be increased with refilling rate maintained.

Evaluation

The liquid ejection head and the comparative liquid ejection head were each installed in an ejection apparatus. Ink was ejected from each of the liquid ejection head and the comparative liquid ejection head toward a sheet of recording paper. In the case of ejecting the ink from the comparative liquid ejection head at high duty, white stripes were formed. This is probably because the ink cannot be ejected through the discharge ports of the comparative liquid ejection head because of insufficient refilling rate. On the other hand, the ink was ejected from the liquid ejection head at high duty without any problems.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-160773 filed Jun. 19, 2008, which is hereby incorporated by reference herein in its entirety.

What is claimed is:

1. A method for manufacturing a liquid ejection head including a substrate and a member which is disposed above the substrate and which has passage communicatively connected to discharge port through which a liquid is ejected, the method comprising:

providing first solid layers made of a positive photosensitive resin above the substrate such that outer side surfaces of the first solid layers form an obtuse angle with the substrate;

providing a second solid layer above the substrate such that the second solid layer abuts the outer side surfaces of the first solid layers, the second solid layer being processed into at least one portion of a mold for the passage;

forming at least one portion of the mold for the passage from the second solid layer;

exposing portions of the outer side surfaces of the first solid layers through the second solid layer;

removing the exposed portions from the first solid layers;

providing a cover layer over the portion of the mold for the passage and;

removing at least the portion of the mold to form the passage for forming the member.

2. The method according to claim 1, wherein the second solid layer is provided over the first solid layers.

3. The method according to claim 1, wherein before the first solid layers are exposed, the second solid layer is patterned into a pattern having a shape corresponding to the passage.

4. The method according to claim 1, wherein the outer side surfaces of the first solid layers are shaped by exposing the positive photosensitive resin disposed above the substrate.

5. The method according to claim 2, wherein after the second solid layer is formed over the first solid layers, the second solid layer is polished.

6. The method according to claim 5, wherein the second solid layer is polished such that the first solid layers are uncovered.

7. The method according to claim 1, wherein the second solid layer transmits light used to expose the first solid layers and has a transmittance of 80% or more.

8. The method according to claim 1, wherein the first solid layers are globally exposed.

9. A method for manufacturing a liquid ejection head including a substrate and a member which is disposed above the substrate and which has passage communicatively connected to discharge port through which a liquid is ejected, the method comprising:

providing first solid layers above the substrate such that outer side surfaces of the first solid layers form an obtuse angle with the substrate;

providing a second solid layer, used to form a mold for the passage, above the substrate such that the second solid layer abuts the outer side surfaces of the first solid layers;

forming the mold for the passages from the second solid layer;

removing the first solid layers;

providing a cover layer over the mold; and forming the passage by removing the mold.

10. A method for forming a structure, comprising:

providing first solid layers above a substrate such that outer side surfaces of the first solid layers form an obtuse angle with the substrate;

providing a second solid layer made of a positive photosensitive resin above the substrate such that the second solid layer abuts the outer side surfaces of the first solid layers; and removing the first solid layers for forming the structure.

11. A method for forming a structure, comprising:

providing first solid layers made of a positive photosensitive resin above a substrate such that outer side surfaces of the first solid layers form an obtuse angle with the substrate;

providing a second solid layer above the substrate such that the second solid layer abuts the outer side surfaces of the first solid layers;

exposing portions of the outer side surfaces of the first solid layers through the second solid layer; and removing the exposed portions from the first solid layers.

* * * * *